US007867145B2

(12) United States Patent
Bearden

(10) Patent No.: US 7,867,145 B2
(45) Date of Patent: Jan. 11, 2011

(54) HAND EXERCISE DEVICE

(76) Inventor: David Gordon Bearden, P.O. Box 1831, Shelbyville, TN (US) 37162

( * ) Notice: Subject to any disclaimer, the term of this patent is extended or adjusted under 35 U.S.C. 154(b) by 52 days.

(21) Appl. No.: 12/422,728

(22) Filed: Apr. 13, 2009

(65) Prior Publication Data

US 2010/0261581 A1 Oct. 14, 2010

(51) Int. Cl.
*A63B 23/14* (2006.01)
*A63B 21/00* (2006.01)
*A41D 19/00* (2006.01)

(52) U.S. Cl. ..... 482/44; 482/92; 2/160

(58) Field of Classification Search ..... 482/44–49, 482/51, 92, 124, 83; 81/44; 2/160, 161.2, 2/162–163, 115; 600/15, 75
See application file for complete search history.

(56) References Cited

U.S. PATENT DOCUMENTS 3,421,500 A 1/1969 Jacobson
3,636,568 A * 1/1972 Stuner ..... 2/161.6
4,034,979 A 7/1977 Wester
4,678,181 A 7/1987 Ditsch et al.
4,750,734 A 6/1988 Greenfield
5,014,981 A 5/1991 Prelich
5,062,625 A 11/1991 Vonk
5,580,336 A 12/1996 Coallier
5,715,539 A * 2/1998 Benecki et al. ..... 2/160
5,738,613 A 4/1998 Clayton
5,950,239 A 9/1999 Lopez
5,989,178 A 11/1999 Chiu
6,050,931 A 4/2000 Russell
6,119,271 A * 9/2000 Byon ..... 2/161.2
6,213,918 B1 4/2001 Rogers, Jr.
7,052,447 B2 * 5/2006 Whittaker ..... 482/124
7,121,983 B1 10/2006 Trent
7,363,660 B1 4/2008 Gilliland et al.
7,381,156 B2 6/2008 Silagy
7,735,153 B1 * 6/2010 Romiti ..... 2/163
2002/0077223 A1 * 6/2002 Zai ..... 482/83
2004/0132538 A1 * 7/2004 Oury et al. ..... 473/205
2006/0185057 A1 8/2006 Terpinski
2007/0155522 A1 * 7/2007 Kim ..... 473/205
2007/0226873 A1 * 10/2007 Mattesky ..... 2/159
2007/0238835 A1 * 10/2007 Chen ..... 525/240
2008/0216207 A1 * 9/2008 Tsai ..... 2/160
2009/0210991 A1 * 8/2009 Tutor ..... 2/161.8

* cited by examiner

*Primary Examiner*—Steve R Crow
(74) *Attorney, Agent, or Firm*—James Addison Barry, Jr.

(57) ABSTRACT

A hand exercise device 100 and method for exercising human hands 102 and digits 104 comprising a plurality of separate digit sleeves 110 wherein the diameter and length are such that the separate digit sleeves 110 slide over the finger and thumb digits 105, 106 of the human hand 102; a magnetic element 120 is attached with the separate digit sleeve 110 near a distal end 116 of the separate digit sleeve 110, wherein the magnetic element 120 will facilitate a desired exercise in multidirectional movements when the magnetic element 120 is approximated near another magnetic 129 or ferrous metal surface 150.

10 Claims, 3 Drawing Sheets

HAND EXERCISE DEVICE

FIELD OF INVENTION

The present invention relates to hand exercise device and methods. More specifically, the hand exercise device and method uses magnetic attractive and repulsive forces for increasing strength, improving function, and providing rehabilitation to the muscles, soft tissues of the fingers, wrists, hands, and forearms of the human arm.

BACKGROUND OF INVENTION

Hand exercisers are a well-known method of exercising the muscles of the fingers, hands, wrists, and forearms to increase the strength/function of these body parts along with rehabilitating the soft tissue (cartilage, ligaments, tendons, nerves) but these hand exercisers have fallen short in many aspects. Previous references that produce an exercise/rehabilitation component typically teach a mechanical means of resistance such as a spring, elastic webbing, rubber band, pulley with weights, elastic bands, loops that fit over the distal end of the fingers that are connected with elastic bands, or a simple rubber ball, but few have shown or proposed that the resistant force could be produced by a means other than a physical resistance, such as a magnetic field. These previous reference devices have used many types of resistance methods that provide the desired exercise, but many have been limited by their mechanical design to provide only a benefit to one group of muscles such as the flexor or extensor muscle groups. U.S. Pat. No. 4,678,181 to Ditsh, et al. discloses a hand exerciser that limits the user to a flexion contraction only. U.S. Pat. No. 5,062,625 to Vonk limits the user to an extension contraction only. U.S. Pat. No. 4,750,734 to Greenfield and U.S. Pat. No. 7,121,983 to Trent both depict a deformable elastic webbing that is attached to a rigid outer frame to hold the elastic webbing tight within a rigid frame, where the user inserts their fingers into openings that are formed within the elastic webbing material to perform the desired exercise against the resistance of the webbing. The fingers can then be exercised in not only flexion/extension exercises, but can also be exercised in abduction/adduction movements. These types of exercisers are a definite improvement over exercisers that offer a one-dimensional exercise, such as only flexion, or only extension.

There are a few previous references to gloves with a magnetic element. U.S. Pat. No. 7,363,660 to Gilliland teaches a modified work glove featuring a magnetic tip that may make it easier to pick up and hold small metal objects by way of a magnet contained in the tip of the glove finger. U.S. Pat. Appl. No. 20060185057 by Terpinski uses a stretchy material to form what is called a finger glove, with a mounted magnet at the distal end of the finger glove. The Magnetic Finger is designed for use in the automotive industry to hold small ferrous metal parts such as nuts, bolts, screws along with other small metallic parts when they are being installed to avoid dropping them, or in a confined area where the entire hand or more than one finger could not be used to install the part. Both Gilliland and Terpinski use a single magnet for attracting and holding a small metal part. In addition U.S. Pat. No. 6,050,931 to Russell teaches a stretchable strap with small permanent magnets that may be strapped around the hand for easing pain and healing effects. U.S. Pat. No. 5,989,178 teaches a magnetic ring worn on the little finger of the hand, around all of the fingers of the hand, or around all of the toes of the foot for aiding circulation in the body. U.S. Pat. No. 3,421,500 to Jacobson discusses a portable orthopedic device that is referred to as a glove with magnetic elements but is a mitten with all fingers moving together. This mitten employs magnetic forces to flex and rehabilitate body members. However, Jacobson does not provide for moving or exercising individual fingers, nor does it utilize an opposable thumb to accomplish a higher level of reconditioning for the human hand.

In the health and exercise field, a device and method are needed that utilizes a magnetic force capable of exercising individual digits of the hand for multiple types of exercises for the hand, fingers, wrist, and forearms of the human arm.

BRIEF DESCRIPTION OF THE DRAWINGS

These and other features, aspects, and advantages of the invention will become better understood with regard to the following description, appended claims, and accompanying drawings where:

DETAILED DESCRIPTION OF THE INVENTION

Figure 1:
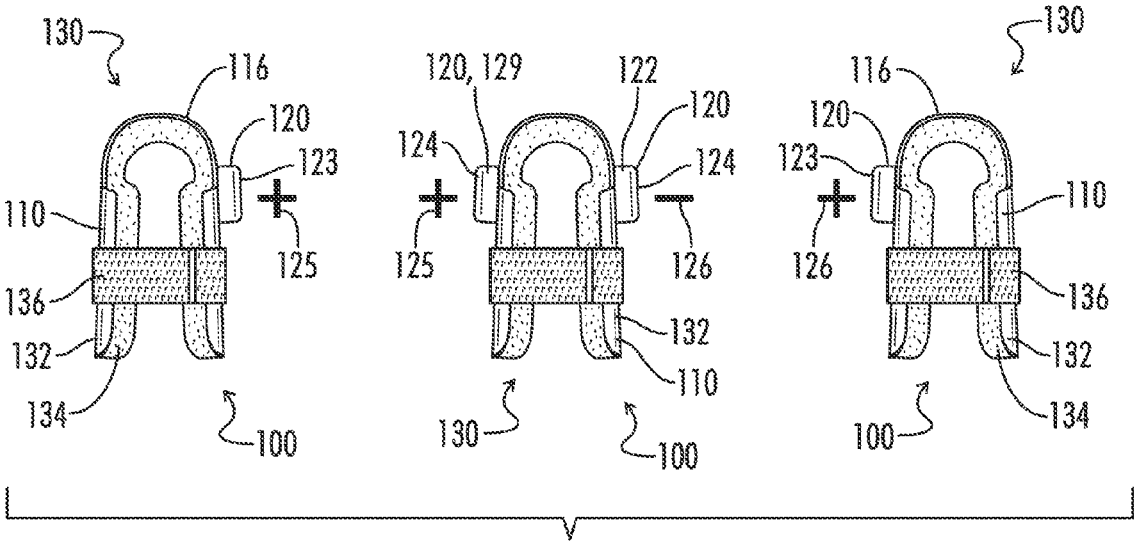
FIG. 1 is a side view of one embodiment of the splint type hand exercise devices depicting two finger sleeves and one thumb sleeve.

The present invention relates to the field of hand exercisers, and provides a means for exercising the fingers, hands, wrists and forearms with magnetic forces. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

A separate digit sleeve is defined as allowing each digit, fingers and thumb to be exercised separate or independently from the other digit. When each individual finger cannot move individually, but must moved as a unit, the stronger finger or fingers will continue to get stronger with an increased range of motion, while the weaker finger or fingers will continue to stay weak, because the stronger finger or fingers will be performing the majority of the exercise. To accomplish the desired exercises and rehabilitation, each individual digit should be exercised on an individual basis to achieve the desired results. The separate digit sleeves may be joined together as a glove as long as the digits are allowed to move individually for individual motion and exercise of the digits. In addition, the use of a magnet attached with each separate and independent digit sleeve allows for multidirectional movement of the digits including the thumb. The thumb performs very important functions with the exercise of the fingers, hands, wrists, and forearms by the fact that the human hands have opposable thumbs. These thumbs can completely and thoroughly exercise, rehabilitate and strengthen the human hand to perform and function at the peak capacity but this requires the use of all the finger digits and the opposing thumb digit operating independently to accomplish and regain the ultimate level of reconditioning on an individual basis.

A magnetic element is defined as any two pieces of material which impart magnetic forces upon each other when brought within a magnetic field created by either or both of the materials. Therefore, the magnetic elements both may be permanent magnets, or a permanent magnet in combination with a piece of material such as steel which is attracted in a magnetic field.

Overview of the Invention:

The hand exercise device 100 is an improved device as well as method for exercising, strengthening, and rehabilitating the muscles, along with the supporting soft tissue of the fingers, hands, wrists, and forearms by using the inherent energy of magnets that provide both the attractive and repulsive forces for exercise, strength, and rehabilitation without the use of a mechanical means for resistive force to accomplish this action.

As depicted in FIGS. 1 through 3B, the hand exercise device 100 comprises a plurality of separate digit sleeves 110 with at least one magnetic element 120 attached with each of the separate digit sleeves 110 near the distal end 116 of the separate digit sleeve 110. The separate digit sleeves 110 have a diameter and length such that the separate digit sleeves 110 slide over the individual finger digits 105 and thumb digit 106 of a human hand 102. The magnetic element 120 facilitates the desired exercise with multidirectional movements when the magnetic element 120 is approximated near another magnetic element 120. The method for exercising with the hand exercise device 100 may include but is not limited to inserting finger digits 105 in the finger separate digit sleeves 112, inserting thumb digits 106 in the thumb separate digit sleeve 114, moving the finger digits 105 with the finger separate digit sleeve 112 and the thumb digits 106 with the thumb separate digit sleeve 114 together, and moving the finger digits 105 with the finger separate digit sleeve 112 and the thumb digits 106 with the thumb separate digit sleeve 114 apart such that the movement of the separate digit sleeves 110 with the magnetic elements 120 provide for exercise, strength, and rehabilitation of the fingers, hands, wrists and forearms.

Design Specifications:

When using typical mechanical means such as elastic material and spring types of resistance for opposition to exercise and for rehabilitation, the resistant force is predictable and consistent in a predictable line of movement. When using a non-mechanical means such as magnetic repulsion, the exercise and rehabilitation component is performed in an advantageous unpredictable erratic movement when the magnets that are attached with the finger digit sleeves are approximated to the magnet attached with the thumb digit sleeve and the magnets are a like polarity. When the magnets in the finger digit sleeves are approximated to the magnet in the thumb digit sleeve are the like polarity the energy field between the opposing forces will create an erratic type of exercise that cannot be achieved when using a mechanical means for resistance. Another advantage of non-mechanical means for resistance in exercise and rehabilitation is that there are no mechanical parts involved in the exercise and the rehabilitation to fatigue or fail due to the fact that magnetic resistance is consistent in resistant forces whether in an attractive or a repulsive component. With the non-mechanical magnetic resistance there are no elastic webbing, elastic rubber bands or any type of elastic material to crack or be stretched beyond the limits of the material while trying to provide the resistance that is needed to effectively exercise and rehabilitate the fingers, hands, wrists, and forearms of the human arm.

Methods of manufacturing the hand exercise device include but are not limited to a splint type 130 of hand exercise device and a glove type 140 of hand exercise device.

Figure 2:
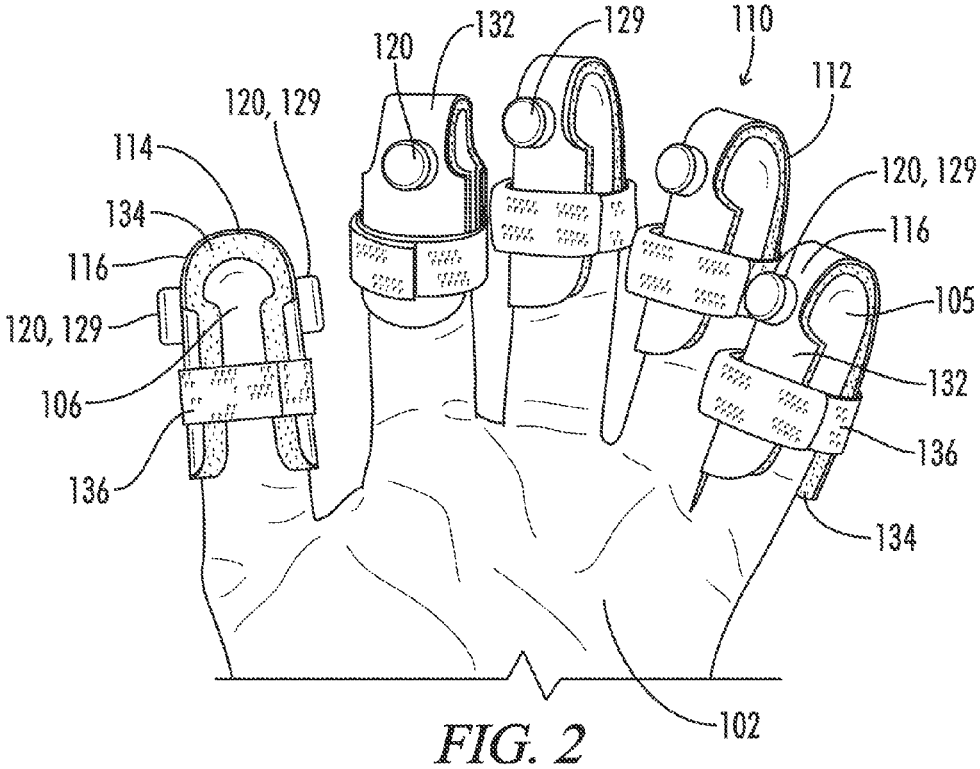
FIG. 2 is a perspective view of one embodiment of the splint type hand exercise device placed on the human hand depicting four finger sleeves and one thumb sleeve.

As illustrated in FIGS. 1 and 2 with the splint type 130 of digit sleeve hand exercise device 100, the separate digit sleeve 110 may include an aluminum finger splint 132 as the separate digit sleeve 110. A magnetic element 120 is attached with the separate digit sleeve 110 near the distal end 116 of the separate digit sleeve 110. One means of attaching the magnetic element 120 to the separate digit sleeve 110 is bonding the magnetic element 120 which may be a magnet 129 with the separate digit sleeve 110 or aluminum finger splint 132 with an adhesive. A strip of hook and loop style fabric 136 or an elastic or rubber band may be used around the separate digit sleeve 110 to securely hold the separate digit sleeve 110 with the finger digit 105 and the thumb digit 106 of the human hand 102 that will keep the separate digit sleeve 110 from moving when exercising. In addition padding 134 may be bonded to the separate digit sleeve 110 for comfort while using the hand exercise devise 100 and to help secure the separate digit sleeve 110 in place in relation to the finger digit 105 or thumb digit 106 while exercising. One embodiment of the hand exercise device 100 may include a plurality of separate digit sleeves 110 wherein the diameter and length are such that the separate digit sleeves 110 slide over individual digits of the human hand 102 and the separate digit sleeves 110 are in the form of a splint 130. A magnetic element 120 is attached with each separate digit sleeve 110 near a distal end 116 of each separate digit sleeve 110, wherein the magnetic element 120 facilitates a desired exercise with multidirectional movements when the magnetic element 120 is approximated near a second magnetic element 122. A finger separate digit sleeve 112 has at least one magnetic element 123 that is a magnet 129 and a thumb separate digit sleeve 114 has at least two magnetic elements 124 that are magnets 129 and one of the at least two magnets 124 of the thumb separate digit sleeve 114 is a like polarity 125 as the magnet 129 for the magnetic element 120 of the finger separate digit sleeve 112 and the other of the at least two magnetic elements 120 of the thumb separate digit sleeve 114 is an opposite polarity 126 from the magnet 129 of the finger separate digit sleeve 112 wherein the thumb separate digit sleeve 114 may be rotated approximately 180 degrees on the thumb digit 106 such that a repulsive force may be changed to an attractive force and the attractive force may be changed to the repulsive force dependent upon the orientation of the thumb separate digit sleeve 114.

Figure 3A:
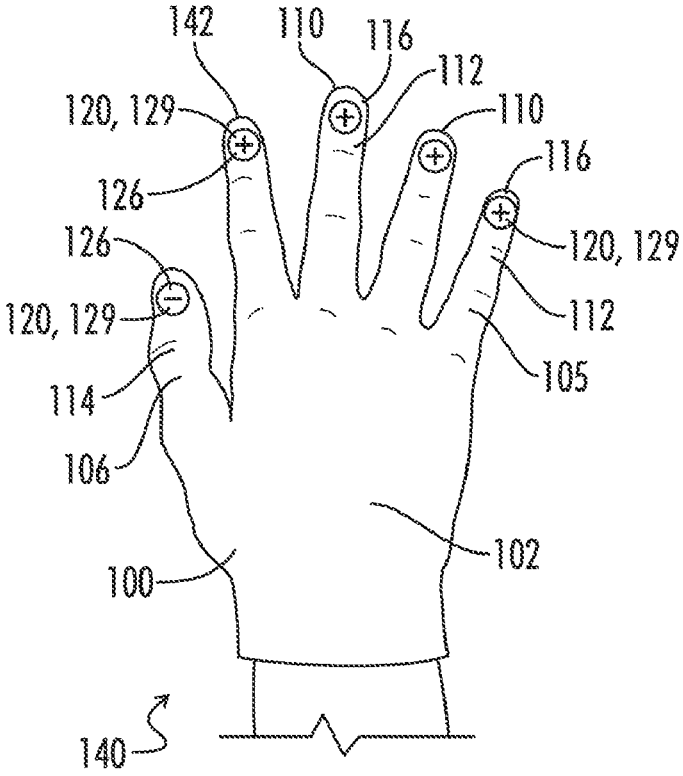
FIG. 3A depicts one embodiment of the glove type hand exercise device with opposite polarity placed on the human hand.
Figure 3B:
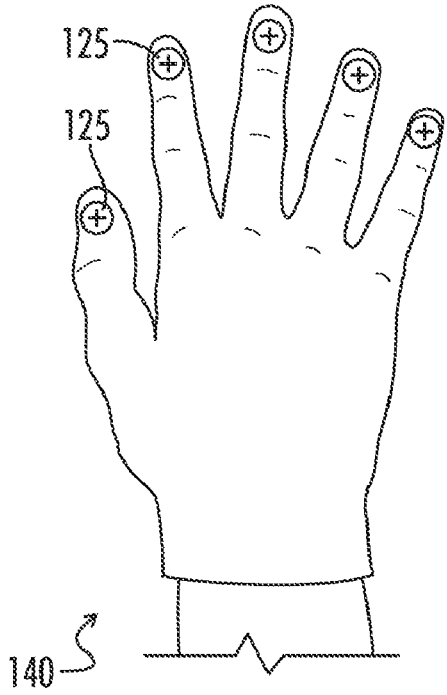
FIG. 3B depicts one embodiment of the glove type hand exercise device with similar polarity placed on the human hand.
Figure 4:
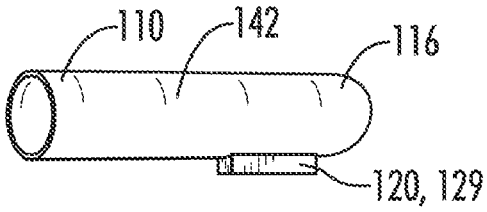
FIG. 4 is a side view of the hand exercise device depicting one embodiment of one separate digit sleeve with a magnet attached with the separate digit sleeve.
Figure 5:
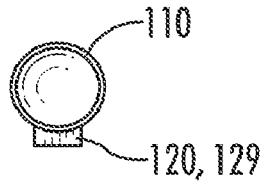
FIG. 5 is an end view of the hand exercise device depicting an embodiment of one separate digit sleeve with a magnet attached with the separate digit sleeve.
Figure 6:
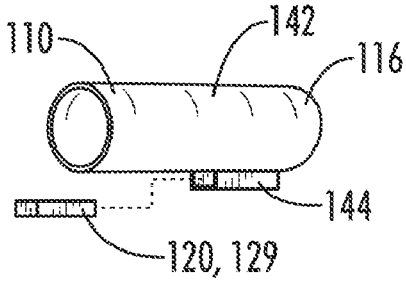
FIG. 6 is a side view of the hand exercise device depicting another embodiment of the separate digit sleeve with a cavity for interchanging various magnets with the separate digit sleeve.

As depicted in FIGS. 3A through 6 with the glove type 140 of digit sleeve hand exercise device 100, the separate digit sleeve 110 may include elastic or stretchable material 142 that may be cut in contoured strips and then sewn together as is typical of the fingers of a glove. The separate digit sleeve 110 will fit snugly around the finger digit 105 and the thumb digit 106 of the human hand 102. The magnetic elements 120 or magnets 129 of the separate digit sleeve 110 may be either sewn into the distal portion 116 of the separate digit sleeve 110, inserted into a pocket 144 sewn into the separate digit sleeve 110, or bonded with the separate digit sleeve 110 with adhesive. The pocket 144 attachment of the magnetic element 120 with the separate digit sleeve 110 may include a cavity or pocket 144 sewn into the separate digit sleeve 110 at the distal end 116 of the separate digit sleeve 110 such that a magnet 129 may be inserted or removed and still be snug enough to hold the magnet 129 firmly with the separate digit sleeve 110. The cavity or pocket allows the interchange of magnetic elements or the adjusting of the magnet strength between weak and strong as well as changing the polarity of the magnet. The magnetic elements 120 contained in the separate digit sleeves 110 should be of an appropriate strength to accomplish the desired exercise and rehabilitation exercise. The separate digit sleeve 110 has a minimum of one magnetic element 120 per separate digit sleeve 110, whether finger separate digit sleeve 112 or thumb separate digit sleeve 114, with the glove type 140 configuration. As shown in FIG. 3A, another embodiment of the hand exercise device may include a plurality of separate digit sleeves 110 wherein the diameter and length are such that the separate digit sleeves 110 slide over individual digits of the human hand 102 and the separate digit sleeves 110 are in the form of a glove 140. A magnetic element 120 is attached with each separate digit sleeve 110 near a distal end 116 of each separate digit sleeve 110, wherein the magnetic element 120 facilitates a desired exercise with multidirectional movements when the magnetic element 120 is approximated near a second magnetic element; wherein the magnetic elements 120 are magnets 129 and wherein one of the separate digit sleeves 110 is a thumb separate digit sleeve 114 for a thumb digit 106, and the magnet 129 for the thumb separate digit sleeve 114 is attached with the thumb separate digit sleeve 114 and orientated with an opposite polarity 126 with the magnets 129 for finger separate digit sleeves 112 for finger digits 105 such that the magnet 129 for the thumb separate digit sleeve 112 is attracted with the magnet 129 for the finger separate digit sleeve 112 such that an extension contraction exercise is produced when the thumb separate digit sleeve 114 and the finger separate digit sleeves 112 are pulled apart. As depicted in FIG. 6, with a pocket or cavity the polarity may be changed for the magnetic element. As illustrated in FIG. 3B, the polarity of the thumb separate digit sleeve 114 may be reversed wherein the thumb separate digit sleeve 114 and the finger separate digit sleeve 112 polarity may change from the opposite polarity 126 previously mentioned to a like polarity 125 such that the magnet 129 for the thumb separate digit sleeve 114 is repulsed with the magnet 129 for the finger separate digit sleeve 112 such that an erratic flexion contraction exercise is produced when the thumb separate digit sleeve 114 and the finger separate digit sleeves 112 are moved toward each other. Erratic is defined for this application as having no fixed course, wandering, not consistent, deviating from the ordinary, and moving in ways that are not expected. The following helps to illustrate this. When the magnets with the digit sleeves are in a like pole, and then approximated towards each other, the inherent energy of the magnetic field will cause the digits to be repulsed away from each other when the digits are performing the flexion contraction exercise. This magnetic repulsion will result in erratic, unpredictable movements of the digits that cannot be predicted or expected, that will produce exercise for the flexor muscle groups of the digits in the human hand in multidirectional movements. The user may turn the digit sleeves, approximately 180° to exercise the extensor muscle groups of the human hand. Whereas hand exercise devices that use mechanical means for resistance to exercise are predictable, and consistent in the direction that the digits can be moved in to produce the desired exercise. When using the non-mechanical means of magnetic forces of the current hand exercise device with magnetic elements to provide this erratic resistance for exercise, it will cause the muscles and/or soft tissue of the human hand to move in directions that are inconsistent, cannot be predicted or expected. The fingers, wrists, hands, forearms, and the associated soft tissue of the human arm move in a wide range of motion. Many previous hand exercise devices are limited as to what range of motion is possible due to their mechanical design. When the main goal of the doctor, physical therapist or home user is to strengthen and/or rehabilitate the fingers, wrists, hands, forearms, associated soft tissue of the human arm it is desirable that these body parts are able to move in all of the ranges of motion that they were created to perform, which the current hand exercise device with magnetic elements allows by using a non-mechanical means in the form of magnetic energy.

Manner of Use:

As depicted in FIGS. 2, 3A, 3B, 7, 8, and 9, the following list includes but does not limit the exercises that may be performed using the hand exercise device when the separate digit sleeves 110 are placed on the fingers of the user:

1. When the magnets 129 in the finger separate digit sleeves 112 are in an opposite polarity 126 with the magnet 129 in the thumb separate digit sleeve 114, the magnets 129 of the finger separate digit sleeves 112 are alternately approximated to the magnet 129 of the thumb separate digit sleeve 114 by an attractive force that pulls the magnets 129 of the finger separate digit sleeves 112 together with the magnet 129 of the thumb separate digit sleeve 114, then pulled apart to provide the extension exercise.
2. When the magnets 129 in the finger separate digit sleeves 112 are in the same or like polarity 125 with the magnet 129 of the thumb separate digit sleeve 114, the magnets 129 of the finger separate digit sleeves 112 are alternately approximated to the magnet 129 of the thumb separate digit sleeve 114 that repels the magnets 129 of the finger separate digit sleeves 112 from the magnet 129 of the thumb separate digit sleeve 114 to produce an erratic flexion exercise.
3. When all of the digits on both hands are inserted into either a finger separate digit sleeve 112 or a thumb separate digit sleeve 114, the users left and right hands are approximated towards each other whereby the users hands will be exercised against each other depending upon whether the magnets 129 of the thumb separate digit sleeves 114, the magnets 129 of the finger separate digit sleeves 112 are in a like polarity 125 or an opposite polarity 126. The finger digits 105 with the finger separate digit sleeves 112 and the thumb digit 106 with the thumb separate digit sleeve 114 are placed on a flat or waveform ferrous metal surface 151, 152, then spread apart to perform the abduction exercise. The finger digits 105 with the finger separate digit sleeves 112 and the thumb digit 106 with the thumb separate digit sleeve 114 are placed on a flat or waveform ferrous metal surface 151, 152, then after the abduction exercise is performed by spreading the fingers and thumb digits 105, 106 apart, the fingers and thumb digits 105, 106 are brought together to perform the adduction exercise.

4. The finger digits 105 with the finger separate digit sleeves 112 and the thumb digit 106 with the thumb separate digit sleeve 114 are placed on a waveform ferrous metal surface 152, the finger digits and thumb digits 105, 106 can then perform an abduction, adduction, flexion, extension exercise in a fluid motion without the finger digits 105 having to be repositioned to perform the different exercises.

As shown in FIGS. 1 through 6, one method for exercising with a hand exercise device 100 includes, the method comprising the steps of inserting a finger digit 105 in the finger separate digit sleeve 112; inserting a thumb digit 106 in the thumb separate digit sleeve 114; moving the finger digit 105 with the finger separate digit sleeve 112 and the thumb digit 106 with the thumb separate digit sleeve 114 together; and moving the finger digit 105 with the finger separate digit sleeve 112 and the thumb digit 106 with the thumb separate digit sleeve 114 apart wherein the movement of the separate digit sleeves 110 with magnetic elements 120 provide for exercise, strength, and rehabilitation of the fingers, hands, wrists and forearms. Another method wherein the magnetic element 120 of the finger separate digit sleeve 112 and the magnetic element 120 of the thumb separate digit sleeve 114 are of opposite polarity 126 may further include the step of moving the finger digit 105 and the thumb digit 106 together by attractive forces is a pulling apart motion for extension exercises. Yet another method wherein the magnetic element 120 of the finger separate digit sleeve 112 and the magnetic element 120 of the thumb separate digit sleeve 114 are of like polarity 125 includes the step of moving the finger digit 105 and the thumb digit 106 together against the repulsive forces of the magnetic element 120 is an erratic flexion motion for exercise.

Figure 7:
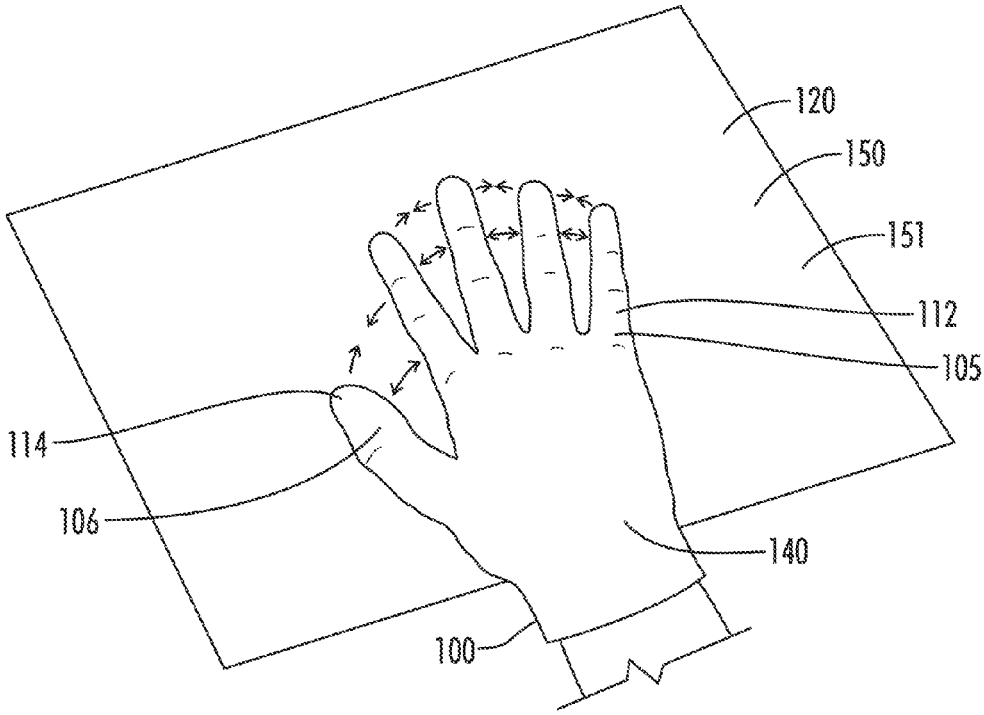
FIG. 7 depicts one embodiment of the hand exercise device and one method of using the hand exerciser on a ferrous metal surface.

As depicted in FIG. 7, another method for exercising with a hand exercise device 100 wherein one of the magnetic elements 120 is a flat ferrous metal surface 151 and the method of exercising includes the steps of: placing the finger separate digit sleeves 112 with the finger digit 105 and the thumb separate digit sleeve 114 with the thumb digit 106 on the flat ferrous metal surface 151 and moving the finger digits 105 and the thumb digit 106 together and apart.

Figure 8:
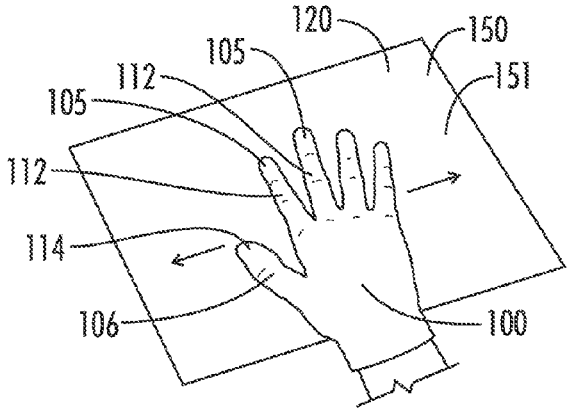
FIG. 8 shows one embodiment of the hand exercise device and one method of using the hand exerciser on a flat ferrous metal surface.

As illustrated in FIG. 8, one method for exercising with a hand exercise device 100 may include a glove type 140 hand exercise device 100 wherein one of the magnetic elements 120 is a flat ferrous metal surface 150, 151. The method may further comprise the steps of: inserting a finger digit 105 in the finger separate digit sleeve 112; inserting a thumb digit 106 in the thumb separate digit sleeve 114; placing the finger separate digit sleeves 112 with the finger digit 105 and the thumb separate digit sleeve 114 with the thumb digit 106 on the flat ferrous metal surface 150, 151; and moving the finger digits 105 with the finger separate digit sleeves 112 and the thumb digit 106 with the thumb separate digit sleeve 114 across the flat ferrous metal surface 150, 151.

Figure 9:
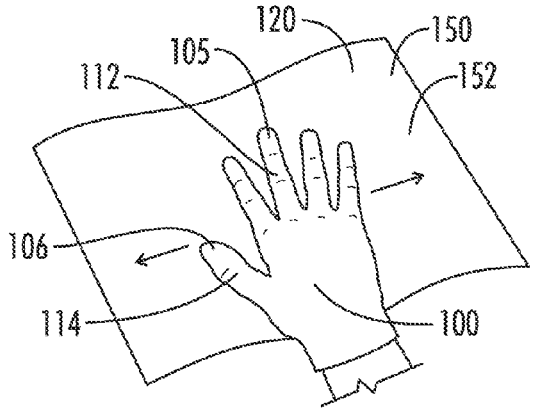
FIG. 9 illustrates one embodiment of the hand exercise device and one method of using the hand exerciser on a waveform ferrous metal surface.

As illustrated in FIG. 9, one method for exercising with a hand exercise device 100 wherein one of the magnetic elements 120 is a waveform ferrous metal surface 150, 152. The method may further comprise the steps of: inserting a finger digit 105 in the finger separate digit sleeve 112; inserting a thumb digit 106 in the thumb separate digit sleeve 114; placing the finger separate digit sleeves 112 with the finger digit 105 and the thumb separate digit sleeve 114 with the thumb digit 106 on the waveform ferrous metal surface 150, 152; and moving the finger digits 105 with the finger separate digit sleeves 112 and the thumb digit 106 with the thumb separate digit sleeve 114 across the waveform ferrous metal surface 150, 152.

Uniqueness:

The purpose of this invention is to allow the physical therapist, doctor, athlete or home user to perform all of the described exercises for the improved function, strength, training, and rehabilitation of the fingers, hands, wrists, and forearms by using only one type of hand exercise device. This hand exercise device will also allow the physical therapist to treat the patient after a stroke, injury, surgery to regain the use of the fingers, hands, wrists, forearms by using various strengths of magnets in the digit sleeves.

The methods provide exercising and strengthening of the muscles of the fingers, hands wrists, and forearms of the human arm. The methods not only exercise and strengthen the muscles of the fingers, hands, wrists, forearms but also their associated soft tissues including ligaments, tendons, cartilage, and nerves to provide rehabilitation for the fingers, hands, wrists, forearms, along with their associated soft tissue. The methods achieve a balance in all of the opposing muscle groups that must be obtained for optimal strength and function of the fingers, hands, wrists, forearms. In addition the methods reinforce and maintain the proper mechanical/structural function of the carpal tunnel by deepening the hollow in the palmar side of the hand and wrist. In addition by reinforcing the carpal tunnel to the proper function structurally and mechanically that impingement of the median nerve will be alleviated. Yet another advantage of the methods is to alleviate repetitive stress injuries by restoring the proper function of the wrists along with the surrounding supporting structures.

What is claimed is:

1. A hand exercise device for exercising human hands and thumb and finger digits comprising:

a plurality of separate digit sleeves wherein the diameter and length are such that the separate digit sleeves each in the form of a splint slide over individual digits of the human hand;

a magnetic element is attached with each separate digit sleeve near a distal end of each separate digit sleeve, wherein a first magnetic element facilitates a desired exercise with multidirectional movements when the first magnetic element is approximated near a second magnetic element;

wherein a finger separate digit sleeve has the magnetic element that is a magnet and a thumb separate digit sleeve has at least two magnetic elements that are magnets wherein one of the at least two magnets of the thumb separate digit sleeve is a like polarity as the magnet of the finger separate digit sleeve and the other of the at least two magnetic elements of the thumb separate digit sleeve is an opposite polarity from the magnet of the finger separate digit sleeve wherein the thumb separate digit sleeve may be rotated approximately 180 degrees on the thumb digit such that a repulsive force may be changed to an attractive force and the attractive force may be changed to the repulsive force dependent upon the orientation of the thumb separate digit sleeve with respect to a finger separate digit sleeve.

2. The hand exercise device as set forth in claim 1 wherein one of the magnetic elements is a flat ferrous metal surface such that a resistance is facilitated for the movement of the human hand with digits.

3. The hand exercise device as set forth in claim 1 wherein one of the magnetic elements is a waveform ferrous metal surface such that a resistance is facilitated for the movement of the human hand with digits.

4. A method for exercising with a hand exercise device as set forth in claim 1, the method comprising the steps of:

inserting a finger digit in the finger separate digit sleeve;

inserting a thumb digit in the thumb separate digit sleeve;

moving the finger digit with the finger separate digit sleeve and the thumb digit with the thumb separate digit sleeve together; and moving the finger digit with the finger separate digit sleeve and the thumb digit with the thumb separate digit sleeve apart wherein the movement of the separate digit sleeves with magnetic elements provide for exercise, strength, and rehabilitation of the fingers, hands, wrists and forearms.

5. The method for exercising as set forth in claim 4 wherein the magnetic element of the finger separate digit sleeve and the magnetic element of the thumb separate digit sleeve are of opposite polarity wherein the step of moving the finger digit and the thumb digit together by attractive forces is a pulling apart motion for extension exercises.

6. The method for exercising as set forth in claim 4 wherein the magnetic element of the finger separate digit sleeve and the magnetic element of the thumb separate digit sleeve are of like polarity wherein the step of moving the finger digit and the thumb digit together against the repulsive forces of the magnetic element is an erratic flexion motion for exercise.

7. The method for exercising as set forth in claim 4 wherein one of the magnetic elements is a flat ferrous metal surface and the method of exercising includes the steps of: placing the finger separate digit sleeves with the finger digit and the thumb separate digit sleeve with the thumb digit on the flat ferrous metal surface and moving the finger digits as well as the thumb digit together and apart.

8. A method for exercising with a hand exercise device as set forth in claim 1, the method comprising the steps of:

inserting a finger digit of a first hand in the finger separate digit sleeve;

inserting a thumb digit of the first hand in the thumb separate digit sleeve;

inserting the finger digit of a second hand in the finger separate digit sleeve;

inserting a thumb digit of the second hand in the thumb separate digit sleeve;

moving the first hand with the finger digit with the finger separate digit sleeve and the thumb digit with the thumb separate digit sleeve toward the second hand with the finger digit with the finger separate digit sleeve and the thumb digit with the thumb separate digit sleeve wherein the magnetic elements with the first hand are in a like polarity with the magnetic elements of the second hand wherein the movement of the hands with the separate digit sleeves with magnetic elements provide for exercise, strength, and rehabilitation of the fingers, hands, wrists and forearms.

9. A method for exercising with a hand exercise device as set forth in claim 1, the method comprising the steps of:

inserting a finger digit of a first hand in the finger separate digit sleeve;

inserting a thumb digit of the first hand in the thumb separate digit sleeve;

inserting the finger digit of a second hand in the finger separate digit sleeve;

inserting a thumb digit of the second hand in the thumb separate digit sleeve;

moving the first hand with the finger digit with the finger separate digit sleeve and the thumb digit with the thumb separate digit sleeve toward the second hand with the finger digit with the finger separate digit sleeve and the thumb digit with the thumb separate digit sleeve wherein the magnetic elements with the first hand are in an opposite polarity with the magnetic elements of the second hand wherein the movement of the hands with the separate digit sleeves with magnetic elements provide for exercise, strength, and rehabilitation of the fingers, hands, wrists and forearms.

10. A method for exercising with a hand exercise device as set forth in claim 1 wherein one of the magnetic elements is a waveform ferrous metal surface, the method further comprising the steps of:

inserting a finger digit in the finger separate digit sleeve;

inserting a thumb digit in the thumb separate digit sleeve;

placing the finger separate digit sleeves with the finger digit and the thumb separate digit sleeve with the thumb digit on the waveform ferrous metal surface; and moving the finger digits with the finger separate digit sleeves and the thumb digit with the thumb separate digit sleeve across the wave form ferrous metal surface.

* * * * *